United States Patent [19]

Kuzunuki et al.

[11] 4,341,287

[45] Jul. 27, 1982

[54] ELEVATOR CONTROL APPARATUS

[75] Inventors: Soshiro Kuzunuki; Kotaro Hirasawa; Masumi Imai, all of Hitachi; Takeo Yuminaka, Katsuta; Kazuhiro Sakata, Katsuta; Kanji Yoneda, Katsuta, all of Japan

[73] Assignee: Hitachi, Ltd., Tokyo, Japan

[21] Appl. No.: 140,416

[22] Filed: Apr. 14, 1980

[30] Foreign Application Priority Data

Apr. 14, 1979 [JP] Japan ..... 54-44864

[51] Int. Cl.[3] ..... B66B 3/02

[52] U.S. Cl. ..... 187/29 R; 340/21; 318/463

[58] Field of Search ..... 187/29; 318/326–328, 318/463, 464, 603, 618; 324/163, 165, 166; 340/21, 671, 672

[56] References Cited

U.S. PATENT DOCUMENTS 3,728,565 4/1973 O'Callaghan ..... 318/618 X
4,134,476 1/1979 Zolnerovich, Jr. et al. ..... 187/29
4,141,435 2/1979 Satoh ..... 187/29
4,150,734 4/1979 Ohira et al. ..... 187/29
4,228,396 10/1980 Palombo et al. ..... 318/463 X

FOREIGN PATENT DOCUMENTS 579582 11/1977 U.S.S.R. ..... 324/165

*Primary Examiner*—Gene Z. Rubinson
*Assistant Examiner*—W. E. Duncanson, Jr.
*Attorney, Agent, or Firm*—Craig and Antonelli

[57] ABSTRACT

An elevator control apparatus in which a three-phase AC output from a three-phase AC generator rotating with running movement of an elevator car is converted into a train of pulses, and the number of such pulses is counted by a counter which provides a count indicative of the position of the elevator car. When the elevator car is actuated to start from its standstill condition, the running direction of the elevator car is detected on the basis of the direction of phase rotation of the three-phase AC output from the generator, and a predetermined correction data is added to or subtracted from the count depending on the detected running direction of the elevator car so as to correct the count error appearing in the starting stage of the elevator car.

17 Claims, 20 Drawing Figures

ELEVATOR CONTROL APPARATUS

Figure 1:
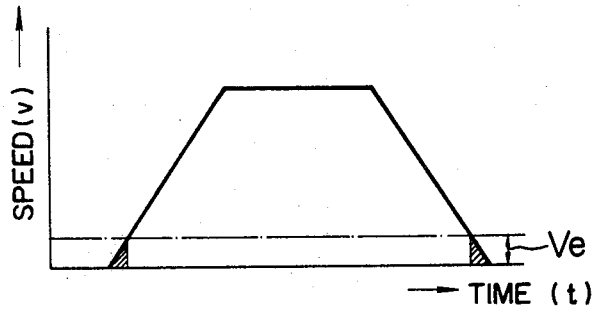

This invention relates to an elevator control system, and more particularly to an elevator control apparatus preferably used for controlling an elevator car by continuously detecting the position of the elevator car.

A mechanical position detecting apparatus generally called a floor controller has been employed hitherto as a means for detecting the position of an elevator car, in which a movable part is adapted to move in interlocking relation with the elevator car over a limited distance of reduced scale which is about 1/10 of the actual travelling distance of the elevator car. This mechanical position detecting apparatus or floor controller includes a plurality of switches for separately detecting individual floor positions. However, because of the limitation in the number of these floor position detecting switches, and also, because of the reduced scale used for the detection of the actual travelling distance of the elevator car, the floor controller of the kind above described has been defective in that the position of the elevator car can only be detected discontinuously, and the accuracy of car position detection is low. In an effort to obviate such a defect, various kinds of digital floor controllers capable of continuously detecting the car position have been proposed up to date.

In one of the proposed digital floor controllers, a pulse generator is mounted on the shaft of a drive unit driving an elevator car, and the number of pulses generated from the pulse generator is counted for indirectly detecting the position of the elevator car. This method contributes to the desired improvement in the performance of the elevator control apparatus since the position of the elevator car can be continuously detected with high accuracy which is in the order of millimeters.

Another method, as disclosed in U.S. Pat. No. 4,150,734, utilizes an inexpensive AC tachometer generator (ACPG) for the car position detection in lieu of the pulse generator employed in the aforementioned method.

This AC tachometer generator is the same in structural and operational principle as a conventional AC generator or a synchronous generator, and its output voltage becomes higher with the increase in the rotation speed. Also, its output frequency becomes higher with the increase in the rotation speed. Therefore, the position of an elevator car can be detected by converting the AC output of the AC tachometer generator into pulses by means such as a voltage zero-cross detector and counting the number of such pulses.

However, utilization of this AC tachometer generator as a means for detecting the position of an elevator car is encountered with such a difficulty that, because the level of the output voltage of the AC tachometer generator is low in a low speed range, the position of the elevator car may not be detected successfully when the elevator car is running at a very low speed which will be referred to hereinafter as an undetectable speed, although such undetectability is concerned with the detectable voltage level of the zero-cross detector.

This undetectable speed range can be considerably narrowed by increasing the amplification degree of the voltage zero-cross detector. However, when this amplification degree is increased until it exceeds a certain level, the residual voltage, magnetostriction, induction noise, etc. in the AC tachometer generator will also be detected by the voltage zero-cross detector, and the zero-cross detector will generate an output even when the car speed is zero. Generation of such an unnecessary output results in undesirable degradation of the accuracy of car position detection. It is therefore necessary that the detectable level of the voltage zero-cross detector be set at a suitable value which ensures the desired accuracy of car position detection.

Because of the fact that the car position detector utilizing the AC tachometer generator is not capable of successfully detecting the position of the elevator car when the elevator car is running at such an undetectable speed, it is unable to obtain the number of pulses indicative of the running speed of the elevator car when the elevator car is moving at a very low speed, as when the elevator car is actuated from its standstill condition or immediately before arriving at a floor.

The presence of a period of time in which the pulses are not detected in the starting stage of the elevator car is especially undesirable in that the count of the counter counting the number of such pulses for detecting the position of the elevator car includes inevitably an error. On the other hand, the elevator car is controlled on the basis of the car position indicated by the count of the counter. As a result, the elevator car is stopped at the destined or target floor with a landing error because the elevator car is controlled on the basis of the detected position including the aforementioned error. Further, when the elevator car immediately before before stopped at the target floor is controlled so as to minimize the landing error, a shock will be imparted to the passengers at the instant of stopping at the floor, and the passengers will be subjected to an uncomfortable ride.

While the manner of elevator control by the use of the AC tachometer generator has been specifically described above, a problem similar to that pointed out above will also arise with the aforementioned pulse generator, as long as it is affected by the rotation speed of the car drive unit.

It is therefore an object of the present invention to provide an elevator control apparatus of such a type that provides for counting the number of pulses generated with the running movement of an elevator car so as to detect the position of the elevator car and controlling the elevator car on the basis of the detected car position, and in which the accuracy of detection of the car position is improved so that the elevator car can arrive at any one of the floors with high landing accuracy.

Another object of the present invention is to provide an elevator control apparatus of such a type that provides for generating the aforementioned pulses by means of a three-phase AC tachometer generator, in which the running direction of the elevator car is detected with high reliability so that the elevator car can be driven under a high degree of safety.

According to a first feature of the present invention, the elevator control apparatus comprises means for correcting the count of a car position detection counter each time the elevator car is actuated from its standstill condition so as to correct the error in the very low speed range.

According to a second feature of the present invention, the elevator control apparatus comprises means for detecting the direction of phase rotation on the basis of the three-phase AC output from the three-phase AC tachometer generator provided for generation of the aforementioned pulses so as to detect the running direction of the elevator car.

Figure 2:
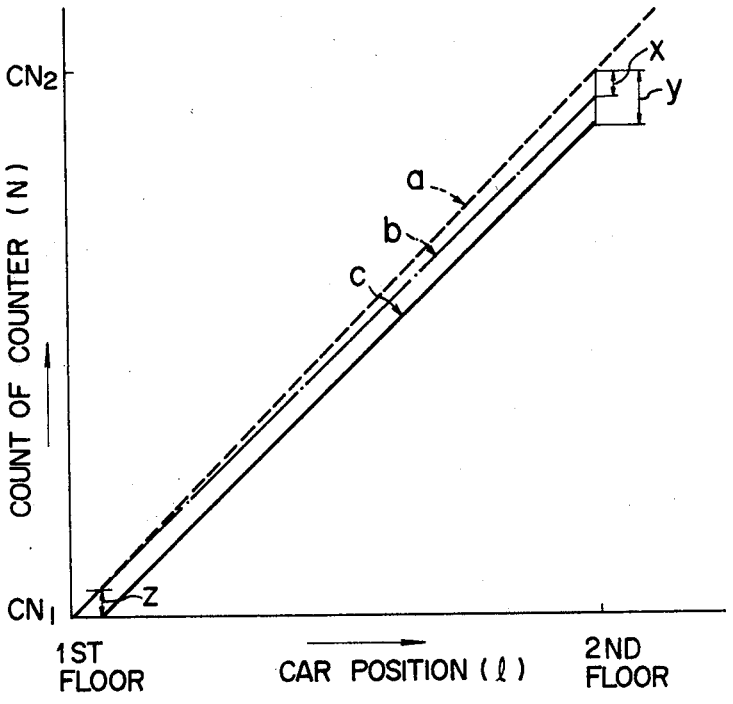
Figure 3A:
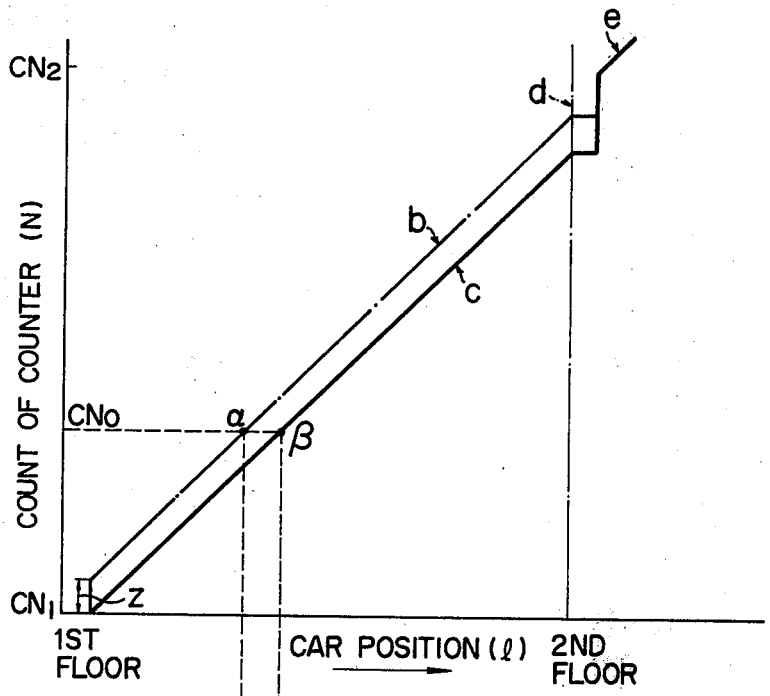
Figure 3B:
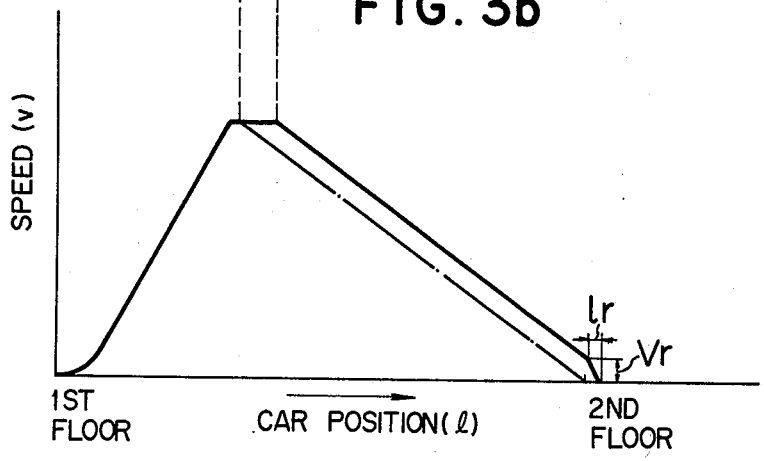
Figure 4:
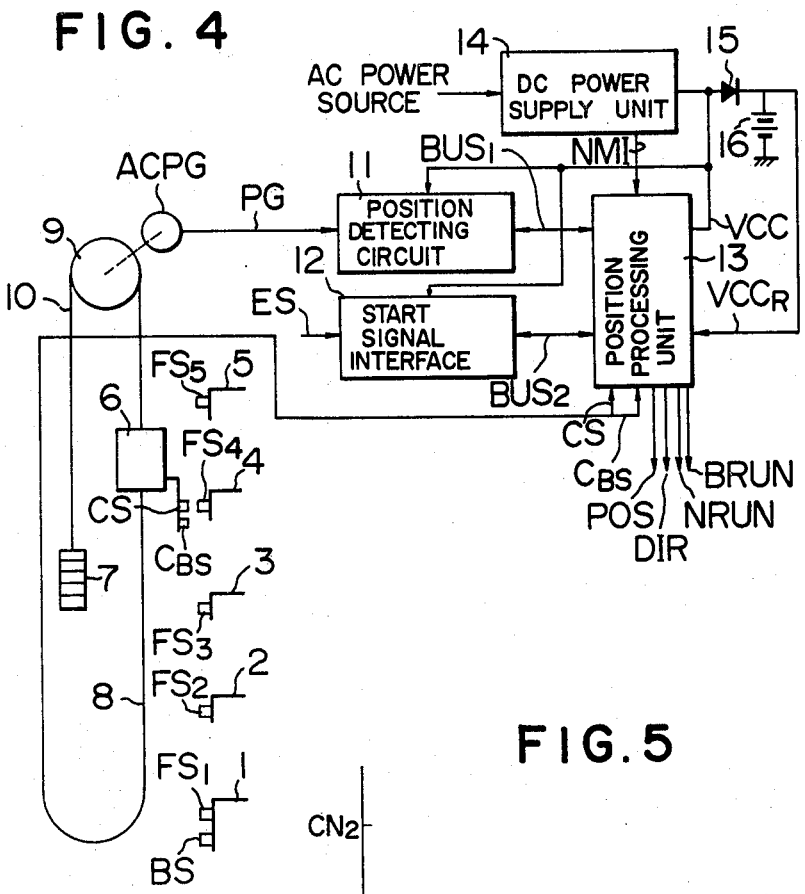
Figure 5:
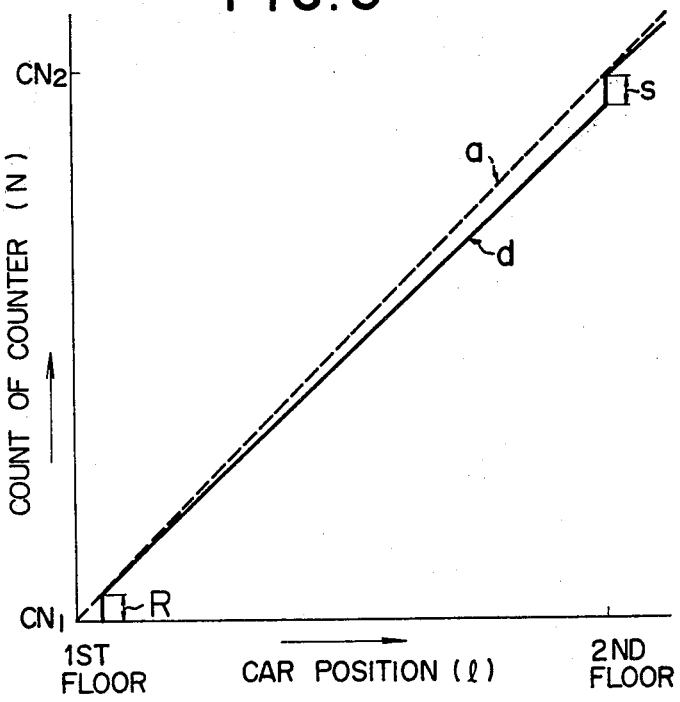
Figure 6:
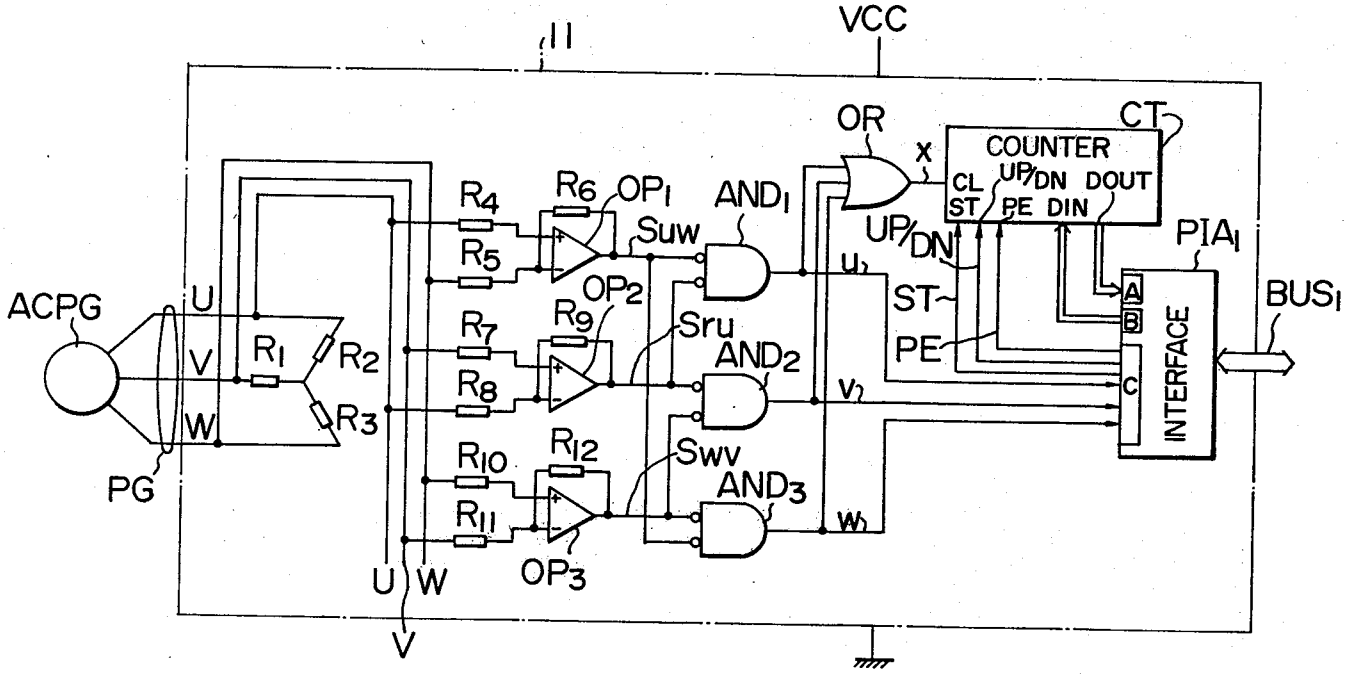
Figure 7:
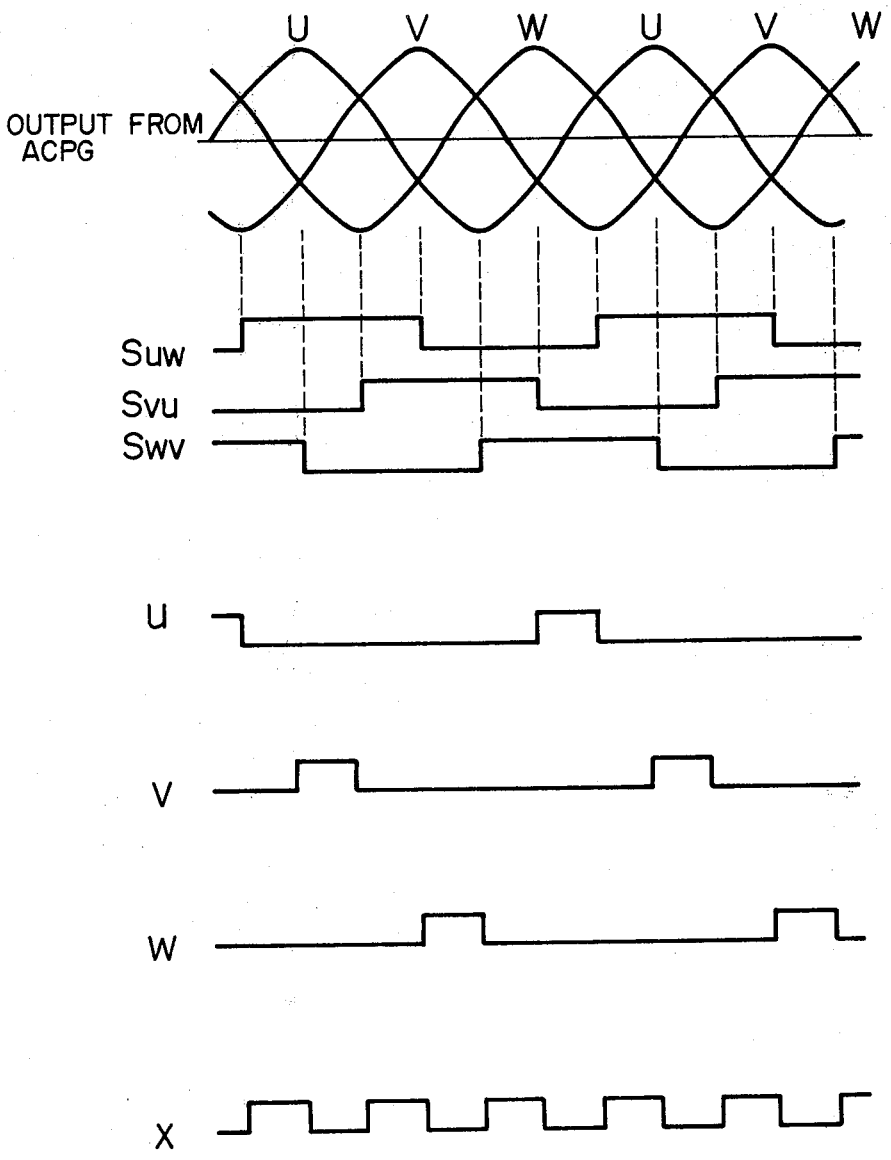
Figure 8:
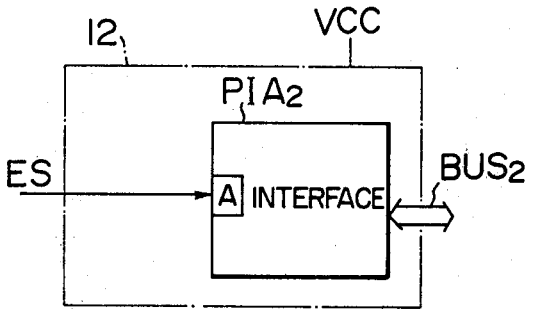
Figure 9:
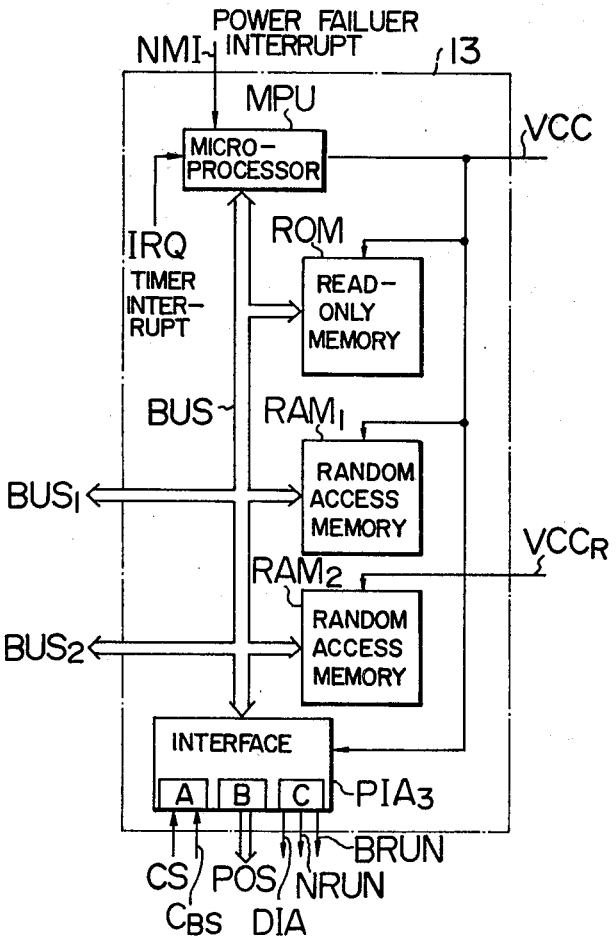
Figure 10:
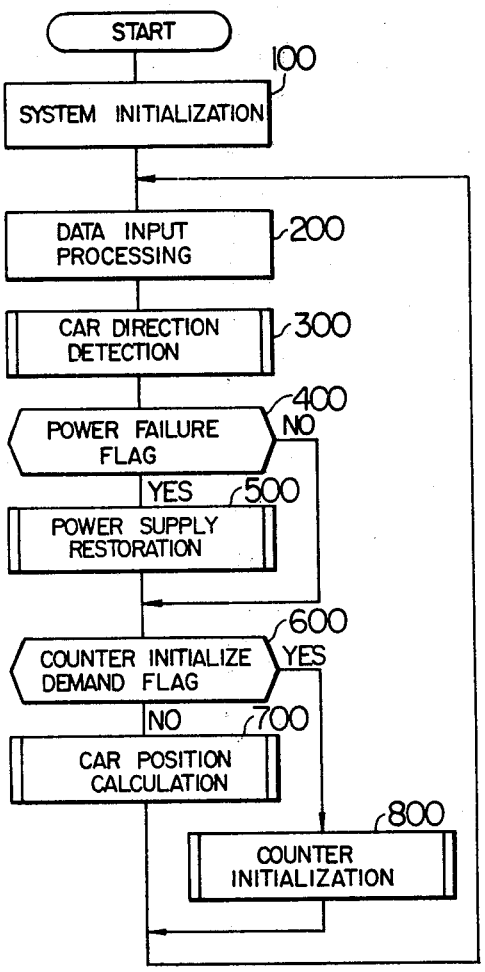
Figure 11:
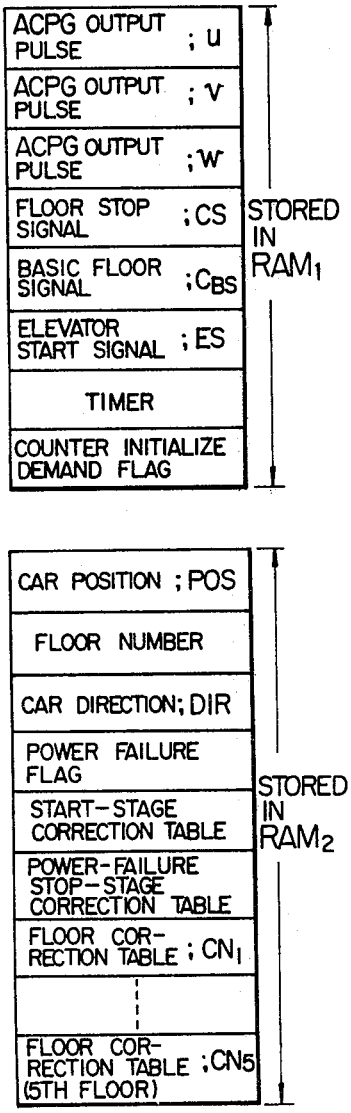
Figure 12:
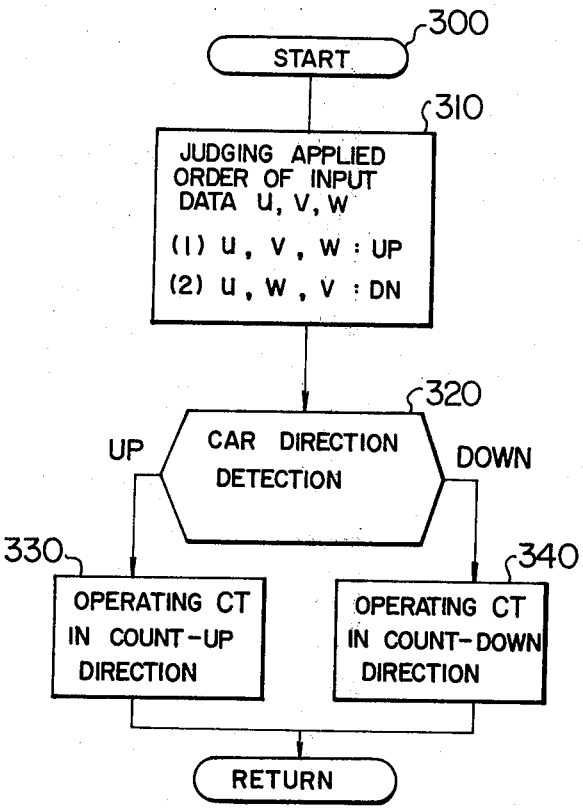
Figure 13:
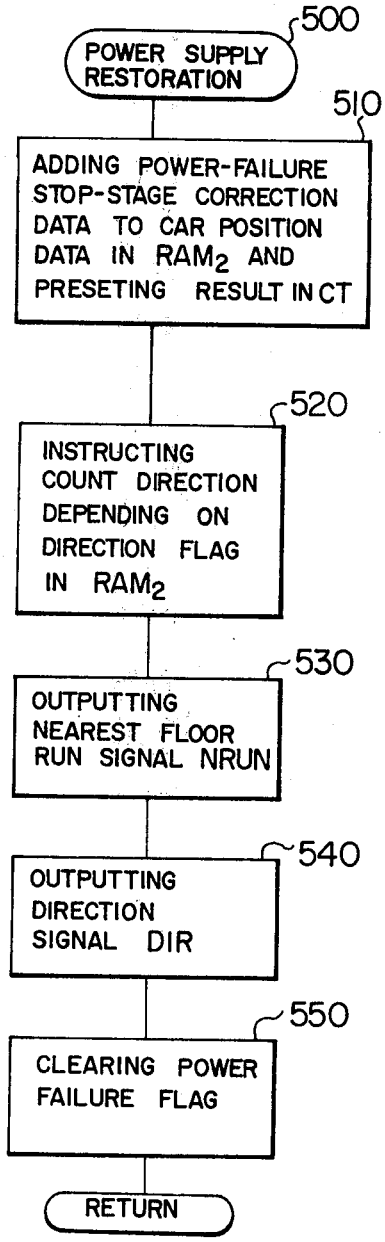
Figure 14:
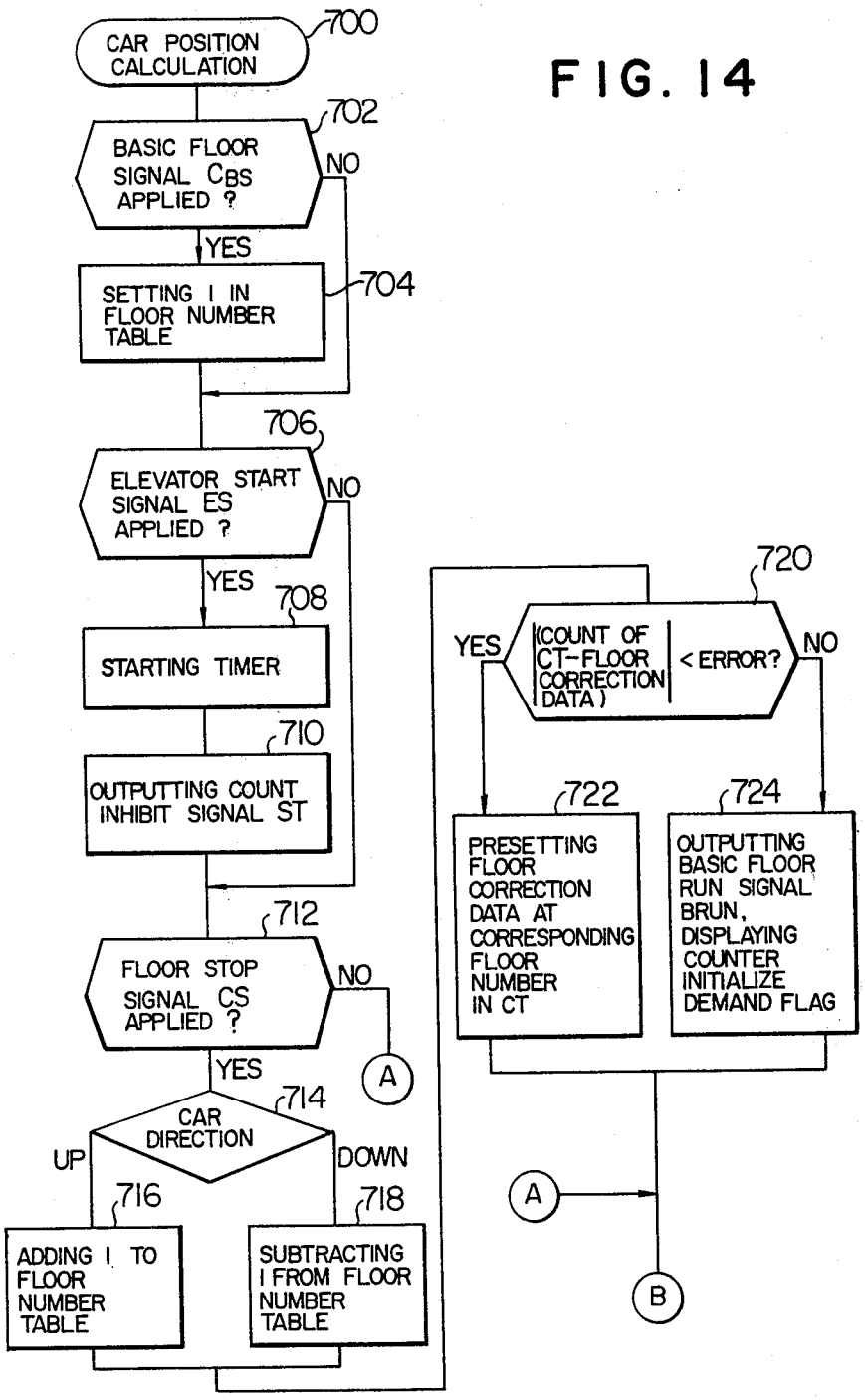
Figure 15:
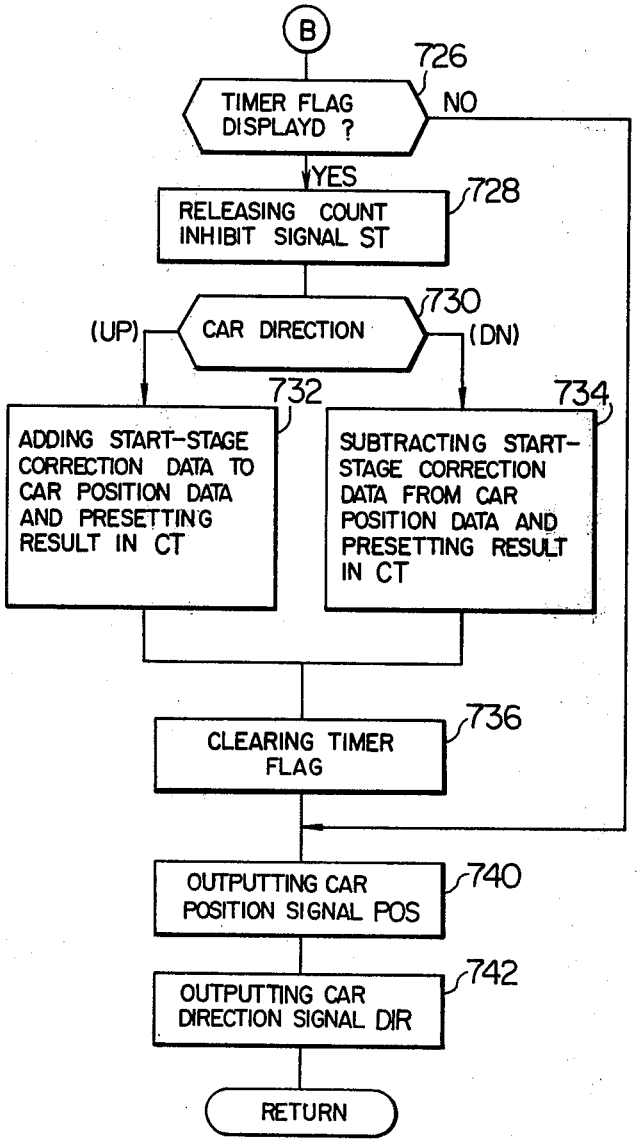
Figure 16:
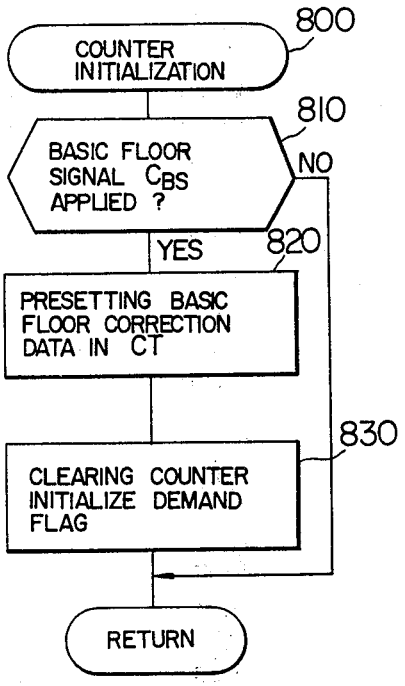
Figure 17:
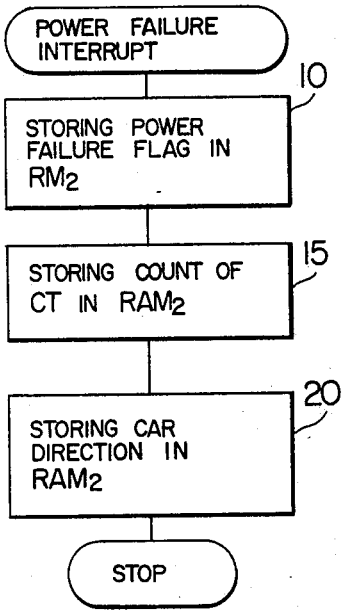
Figure 18:
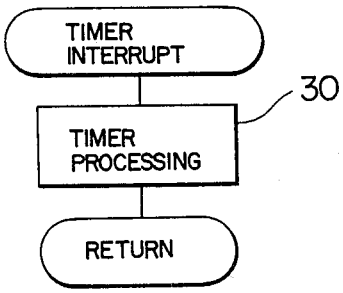
Figure 19:
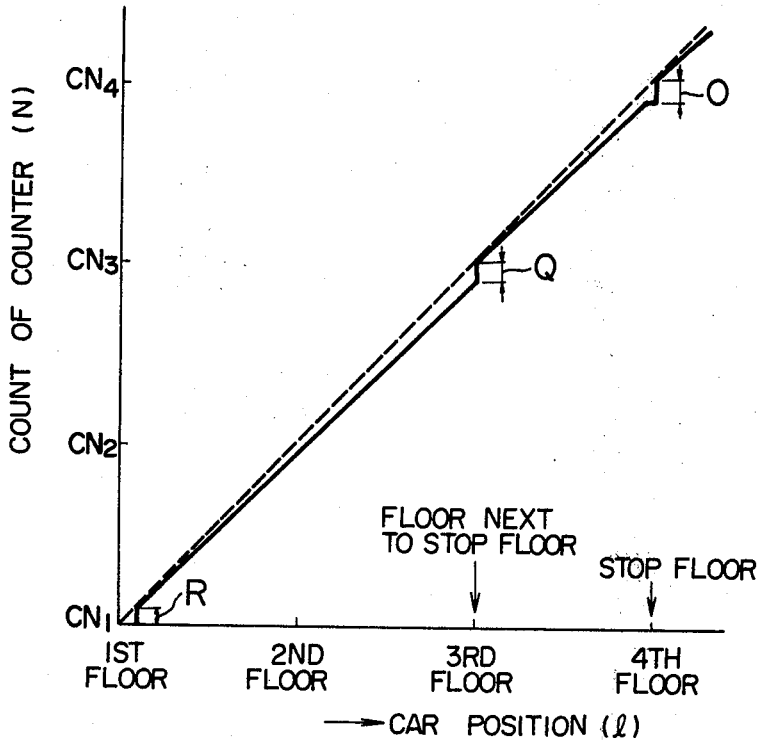

Besides the objects and features described above, a preferred embodiment of the present invention includes various other contrivances which will become apparent from the following detailed description taken in conjunction with the accompanying drawings, in which:

FIGS. 1 to 3 illustrate the basic principle of the present invention, in which, FIG. 1 is a graph showing the speed characteristic of an elevator car, FIG. 2 is a graph showing the count characteristic of a car position detection counter, and FIGS. 3*a* and 3*b* are graphic representations of the relation between the count characteristic of the car position detection counter and the speed characteristic of the elevator car;

FIGS. 4 to 18 show a preferred embodiment of the elevator control apparatus according to the present invention, in which, FIG. 4 is a block diagram of the elevator control apparatus, FIG. 5 is a graph illustrating the operation of the elevator control apparatus shown in FIG. 4, FIG. 6 is a circuit diagram of the car position detecting circuit shown in FIG. 4, FIG. 7 is a time chart illustrating the operation of the car position detecting circuit shown in FIG. 6, FIG. 8 is a circuit diagram of the elevator start signal interface circuit shown in FIG. 4, FIG. 9 is a block diagram of the car position processing unit shown in FIG. 4, FIG. 10 is a flow chart of a main program used for processing in the car position processing unit shown in FIG. 9, FIG. 11 shows a mapping of various data stored in the random access memories in the car positioned processing unit shown in FIG. 9, FIG. 12 is a flow chart of a sub-program used for detecting the running direction of the elevator car, FIG. 13 is a flow chart of a sub-program used for the restoration of power supply after occurrence of power failure, FIG. 14 is a first flow chart of a sub-program used for the arithmetic calculation of the position of the elevator car for the purpose of rationality check, FIG. 15 is a second flow chart of the sub-program used for the arithmetic calculation of the car position for the purpose of rationality check, FIG. 16 is a flow chart of a sub-program used for the initialization of the car position detection counter when the result of the rationality check in FIGS. 14 and 15 provides irrational, FIG. 17 is a flow chart of a power failure interrupt program, and FIG. 18 is a flow chart of a timer interrupt program; and FIG. 19 is a graph showing the count characteristic of the car position detection counter in a modification of the present invention.

For a better understanding of the elevator control apparatus according to the present invention, the basic principle of the operation of the apparatus will be described with reference to FIGS. 1 to 3 before describing the structure and operation of the apparatus in detail.

FIG. 1 is a graph showing the speed characteristic of an elevator car relative to time. It will be seen in FIG. 1 that the elevator car runs at a very low speed $V_e$ immediately after it is actuated from its standstill condition or immediately before it is stopped. At this very low speed $V_e$, the pulses generated from an AC tachometer generator cannot be detected, and this low speed $V_e$ will be referred to hereinafter as an undetectable speed.

FIG. 2 is a graph showing the car position detection characteristic of a counter when such a speed $V_e$ is not detected. In FIG. 2, the horizontal axis represents the position l of the elevator car, and the vertical axis represents the count N of the counter which counts the frequency components of the output from the AC tachometer generator. It is supposed that the elevator car standing still at the 1st floor of a building is actuated to run upward from the 1st floor. The broken curve a in FIG. 2 represents an ideal curve when the undetectable speed $V_e$ is not present and no slip occurs between the elevator car drive unit and the rope suspending the elevator car. The one-dot chain curve b is generally similar to the curve a except that a slip occurs between the drive unit and the rope. The solid curve c differs greatly from the curve a in that the undetectable speed $V_e$ is present and a slip occurs between the drive unit and the rope. This slip does not occur substantially when the elevator car is not so heavily loaded as usual, but it occurs when the elevator car is heavily loaded. This slip occurs most frequently in the starting stage of the elevator car although the time of occurrence of the slip is not always the same and is dependent upon how the drive torque is transmitted. For convenience of explanation, FIG. 2 specifically illustrates that the amount of slip is considerably large and the slip occurs at a constant rate.

It will be seen in FIG. 2 that the pulses generated from the AC tachometer generator are not counted during the period of time in which the elevator car runs at the undetectable speed $V_e$, and an error Z due to this undetectable speed $V_e$ appears in the starting stage of the elevator car.

Consequently, at the time at which the elevator car arrives at the 2nd floor, another error x due to the slip is added to the error Z, and the curve c deviates from the ideal curve a by an amount equal to the sum y of the errors Z and x. This error y gives rise to the landing error of the elevator car when the elevator car is stopped at the 2nd floor, and it also provides a source of a shock imparted to the passengers at the time of arrival of the elevator car at the 2nd floor, as will be explained with reference to FIGS. 3*a* and 3*b*.

This problem arises especially when the elevator car standing still at the 1st floor is actuated to be stopped at the 2nd floor, that is, when the elevator car makes the so-called one-floor-interval running operation as shown in FIGS. 3*a* and 3*b*. Suppose that the elevator car dispatched from the 1st floor to arrive at the 2nd floor is decelerated at a position corresponding to a count $CN_o$ of the counter as shown in FIG. 3*a*. Then, in the case of the curve c including the error Z due to the undetectable speed $V_e$, deceleration is initiated at a car position $\beta$ in FIG. 3*a*. Therefore, in FIG. 3*b* showing the corresponding speed pattern, the speed of the elevator car immediately before arriving at the 2nd floor is $V_r$ in the case of the curve c shown in FIG. 3*a* which includes the error Z due to the undetectable speed $V_e$. As soon as the elevator car reaches the break-applying position very close to the 2nd floor, the electromagnetic brake is energized to accurately stop the elevator car at the normal landing position. Consequently, the elevator car is brought to an abrupt stop, and a shock due to this abrupt stop is imparted to the passengers although the landing error $l_r$ can be reduced to a minimum.

According to the present invention which obviates such a drawback, the error Z due to the undetectable speed $V_e$ shown in FIG. 2 and FIGS. 3*a* and 3*b* is corrected so that the curve c can coincide with the curve b which does not include the error Z. Thus, the elevator car is decelerated at a point $\alpha$ as shown in FIG. 3*a* so that the landing error $l_r$ at the stopping position of the 2nd floor may only include the error component x due to the slip. In other words, the landing error and the stop shock can be eliminated when the elevator car runs in its usual loaded condition, and the landing error as well as the stop shock can be reduced to a minimum even in the presence of the slip between the drive unit and the rope.

The same principle applies to the running movement of the elevator car from, for example, the 1st floor to the 3rd and higher floors. In this case, the count of the counter is forcedly preset at a predetermined count value corresponding to, for example, the 2nd floor at which the car position l is represented by a point ⓓ in FIG. 3*a* so that the extending portion ⓔ of the curve c can coincide with the ideal curve a. It can therefore be seen that the error X due to the slip can also be corrected when the elevator car runs over a range of more than two floor intervals.

A preferred embodiment of the elevator control apparatus according to the present invention will now be described in detail.

FIG. 4 is a block diagram showing the structure of the elevator control apparatus embodying one form of the present invention. Referring to FIG. 4, an elevator car 6 is connected to a counterweight 7 by a rope 10 trained around a drive unit 9. Suppose that a building in which the elevator car is installed has, for example, five floors as designated by 1 to 5, then, there are provided five sectioning members $FS_1$ to $FS_5$ such as magnetic shielding members indicating the stopping positions at the individual floors respectively and another sectioning member BS indicating the basic floor which is the 1st floor in this case. The elevator car 6 is provided with a car position detector CS for detecting the sectioning members $FS_1$ to $FS_5$ and a basic floor detector $C_{BS}$ for detecting the sectioning member BS. These detectors CS and $C_{BS}$ are electrically connected to a car position processing unit 13 by a tail cord 8.

An AC tachometer generator ACPG is coupled to the shaft of the drive unit 9 for interlocking operation therewith and applies its AC output signal PG to a car position detecting circuit 11. An elevator start signal ES for actuating the elevator car 6 is applied from, for example, a contact of a relay in an elevator control circuit (not shown) to an elevator start signal interface 12.

The car position detecting circuit 11 and the elevator start signal interface 12 are connected to the car position processing unit 13 by signal transmission buses $BUS_1$ and $BUS_2$ respectively for interchange of information.

An AC power source supplies AC power to a DC power supply unit 14 which supplies its DC output voltage VCC to the circuits 11, 12 and 13. A floating battery 16 is connected to the DC power source unit 14 through a reverse-current preventive diode 15 which prevents flow of reverse current in the event of occurrence of power failure in the AC power source. This battery 16 supplies its DC output voltage $VCC_R$ to information memory means (described later) in the car position processing unit 13. The DC power supply unit 14 includes a power failure detecting circuit which applies its output signals NMI to the car position processing unit 13 when power failure occurs in the AC power source.

The operation of the embodiment having the aforementioned structure will now be generally described.

At first, the first feature which is the correction of the position of the elevator car 6 whose speed characteristic includes the undetectable speed $V_e$ will be briefly described. Suppose that the elevator car 6 standing still at the 1st floor is actuated to run upward toward the 5th floor. In response to the start command signal appearing in the elevator system, the elevator start signal ES is applied from the elevator control circuit (not shown) to the car position processing unit 13 through the elevator start signal interface 12. In response to the application of the signal ES to the car position processing unit 13, a predetermined value prepared for the correction of the error Z due to the undetectable speed $V_e$ is read out from a memory to be added to or subtracted from the data of the previously detected car position in the car position detecting circuit 11, and the resultant value is preset in a counter in the car position detecting circuit 11 to renew the content of the counter. The counter preset at such a renewed content starts its counting operation again. The relation between the car position l and the count N of the counter in this case is shown in FIG. 5. It will be seen in FIG. 5 that, at a predetermined time after the dispatch of the elevator car 6 from the 1st floor, a correction value R is added to the count N for the purpose of car position correction, so that the count N of the counter approaches that represented by the ideal curve a. It is to be noted herein that the predetermined timing for the correction of the count N of the counter is selected to lie within the period of time after the elevator car dispatched from the 1st floor starts to be accelerated to run toward the target floor but before the acceleration is completed. When the elevator car 6 passes the position of the 2nd floor, the car position detector CS detects the sectioning member $FS_2$ at the 2nd floor position so that another correction value S for correcting the error due to the slip is added to the corrected curve d. Similar correction is sequentially carried out as the elevator car 6 passes the position of each of the successive floors so that the curve d will coincide finally with the ideal curve a. This manner of correction is carried out in the car position processing unit 13, and a car position signal POS indicative of the corrected car position is applied as car position information to the elevator control circuit (not shown) from the car position processing unit 13. This car position processing unit 13 comprises a microcomputer.

The second feature which is the rationality check of the car position in the event of occurrence of power failure will next be briefly described.

When now power failure occurs in the AC power source, the power failure signal NMI appears from the DC power supply unit 14, and a power failure interrupt program (described later) is run in the car position processing unit 13. The processing unit 13 ceases its processing sequence after storing information including the count of the counter in the car position detecting circuit 11, the running direction of the elevator car 6 and the occurrence of power failure, in a memory backed up by the battery 16. The power failure signal NMI is generated when the power supply voltage drops by about 90% of the rated value, and the DC power supply unit 14 is then rendered inoperative in a relatively short period of time after the AC voltage drop. The aforementioned processing sequence is carried out with highest priority within this relatively short period of time.

In the event of occurrence of the power failure, the elevator car 6 is abruptly stopped. When the AC power source is restored after the abrupt stop of the elevator car 6, the elevator car 6 runs at the landing speed toward the nearest floor in the direction in which the elevator car 6 has run before the occurrence of power failure. Upon arrival at the nearest floor, the count of the counter in the car position detecting circuit 11 is compared with corresponding data in a floor table which has been prepared previously by making a test run of the elevator car 6 at the time of its installation and tabulating the accurate count values of the floor positions. When the result of comparison proves that the difference therebetween is rational or smaller than a predetermined value, the elevator car 6 can continue its normal operation from that time. When, on the other hand, the above difference is larger than the predetermined value, the position of the elevator car 6 is out of the correctable range. In other words, the position of the elevator car 6 is so indistinct and instable that its location cannot be definitely detected. In such a case, it is necessary to run the elevator car 6 to the end floor and to reset the counter in the car position detecting circuit 11.

The above description has clarified the outline of the features of the embodiment according to the present invention. The practical structure of the elevator control apparatus embodying the present invention will now be described in detail. The hardware components of the circuits and units constituting the elevator control apparatus embodying the present invention will be described at first, and the processing sequence in the car position processing unit 13 will then be described.

FIG. 6 is a circuit diagram showing the hardware components of the car position detecting circuit 11. The AC tachometer generator ACPG is a three-phase generator, and three resistors $R_1$, $R_2$ and $R_3$ of star connection are connected respectively to the output phases U, V and W of the AC tachometer generator ACPG. These resistors $R_1$, $R_2$ and $R_3$ provide a common grounding means for the car position detecting circuit 11 and the AC tachometer generator ACPG so as to prevent occurrence of a noise voltage. A voltage zero-cross detector composed of resistors $R_4$, $R_5$, $R_6$ and an operational amplifier $OP_1$ is connected across these resistors $R_1$ to $R_3$. Two other similar voltage zero-cross detectors are also provided as seen in FIG. 6. The outputs $S_{uw}$, $S_{vu}$ and $S_{wv}$ from these voltage zero-cross detectors are selectively connected to the input terminals of two-input logic elements or AND elements $AND_1$ to $AND_3$ as shown, and the outputs u, v and w from the respective AND elements $AND_1$, $AND_2$ and $AND_3$ are applied to the C-port of an element $PIA_1$ in the form of an LSI which acts as an interface between the car position detecting circuit 11 and the car position processing unit 13 described later. The outputs u, v and w from the respective AND elements $AND_1$, $AND_2$ and $AND_3$ are also applied to the individual input terminals of a three-input logic element or OR element OR, and the output x from the OR element OR is applied to the clock input terminal CL of a reversible counter CT which is presettable. The reversible counter CT is connected at a plurality of its remaining terminals (described later) to the A-port, B-port and C-port of the interface element $PIA_1$, as shown in FIG. 6.

FIG. 7 illustrates the operation of the car position detecting circuit 11 having the structure above described.

The AC tachometer generator ACPG generates the three-phase AC output. As seen in FIG. 7, the output voltage in each phase has a sinusoidal waveform, and there is a 120° phase difference between the three output phases. When these voltage waveforms are applied to the voltage zero-cross detectors each comprising three resistors and an operational amplifier as described with reference to FIG. 6, the outputs $S_{uw}$, $S_{vu}$ and $S_{wv}$ from the respective voltage zero-cross detectors have a waveform as shown in FIG. 7. When the U-phase voltage waveform and W-phase voltage waveform are applied to the voltage zero-cross detector composed of the resistors $R_4$ to $R_6$ and the operational amplifier $OP_1$, the output $S_{uw}$ from this detector has such a signal waveform that it rises when the U-phase voltage level exceeds the W-phase voltage level and it falls when the W-phase voltage level exceeds the U-phase voltage level. The same applies to the remaining zero-cross detectors. The output signals u, v and w appearing from the respective AND elements $AND_1$, $AND_2$ and $AND_3$ in response to the application of the signals $S_{uw}$, $S_{vu}$ and $S_{wv}$ thereto are pulse signals which have a phase difference of 120° and each of which has a pulse width of 60° as seen in FIG. 7. Therefore, the output signal x from the OR element OR is the logical sum of these three input signals u, v and w and includes a train of alternative pulses each having a pulse width of 60° as seen in FIG. 7.

The reversible counter CT includes a terminal UP/DN which controls the count-up and count-down operation of the counter CT, a terminal ST which controls the start and stop of the operation of the counter CT, a terminal PE which presets the counter CT, and a terminal DIN to which a preset data is applied from the B-port of the interface element $PIA_1$ in the car position detecting circuit 11. Further, the reversible counter CT includes a terminal DOUT through which the count of the counter CT is always readable. This terminal DOUT is connected to the A-port of the interface element $PIA_1$ in the car position detecting circuit 11 so that the count of the reversible counter CT can be read out according to the operations to be described later.

The AC tachometer generator ACPG in the form of the three-phase generator is employed in the present invention for the reasons that generation of pulses three times as many as those generated by a single-phase generator in one revolution improves the accuracy of car position detection and that the running direction of the elevator car can be easily detected by merely finding the order of phase rotation in the three-phase output.

FIG. 8 is a circuit diagram showing the hardware components in the elevator start signal interface 12.

The elevator start signal ES is applied from, for example, a contact of a relay supplying electric power to the car drive motor. This signal ES is applied to the A-port of an element $PIA_2$ in the form of an LSI which acts as an interface between the elevator control circuit (not shown) and the car position processing unit 13 which is actually a microcomputer. The elevator start signal ES is read out according to software described later.

FIG. 9 is a block diagram showing the hardware components of the car position processing unit 13 which is in the form of a microcomputer as described above. Referring to FIG. 9, the car position processing unit 13 comprises a microprocessor MPU which is a central arithmetic unit, a read-only memory ROM storing various programs, random access memories $RAM_1$ and $RAM_2$ storing various kinds of data, and an element $PIA_3$ acting as an interface between the car position processing unit 13 and various external units. These elements are each in the form of an LSI, and a bus BUS interconnects these elements for exchange of information.

The power failure signal NMI for running a power failure interrupt program is connected to the microprocessor MPU to which a timer signal IRQ for running a timer interrupt program at intervals of a predetermined period is also connected. The power failure signal NMI is connected to one of the terminals of the microprocessor MPU so that the power failure interrupt program can be run with highest priority.

The DC voltages VCC and $VCC_R$ provide power requirements for the individual elements of the car position processing unit 13. Especially, the DC voltage $VCC_R$ is continuously supplied even in the event of occurrence of AC power failure since it is supplied from the power source backed up by the battery 16. The random access memory $RAM_2$ is supplied with this DC voltage $VCC_R$ and is in the form of an LSI such as a CMOSRAM whose power consumption is quite low. The capacity of the battery 16 is therefore also considerably small.

In the present invention, the two random access memories $RAM_1$ and $RAM_2$ are provided for storing necessary data. More precisely, the random access memory $RAM_2$ stores a minimum of data required for processing in the course of restoration of power supply, and the random access memory $RAM_1$ stores other data required for routine processing. These two random access memories $RAM_1$ and $RAM_2$ are specifically provided instead of a single random access memory, because the capacity of the battery 16 can be reduced by minimizing the capacity of the memory $RAM_2$ supplied from the power source backed up by the battery 16, and, therefore, the battery 16 is inexpensive and can operate satisfactorily in spite of continuation of power failure over a long period of time.

The above description has clarified the structure and arrangement of the hardware components in the elevator control apparatus embodying the present invention. Description will now be directed to its operation controlled according to software.

Flow of a main program in the embodiment of the present invention will be described with reference to FIG. 10.

In step 100, the car position processing unit 13, in the form of the microcomputer described with reference to FIG. 9 executes its initializer routine required for the initialization of the microcomputer system in response to the turn-on of the power supply. In next step 200, the output signals from the various circuits are applied as data inputs. The input data is as follows:

(1) From $PIA_1$:

(i) ACPG output pulse waveforms u, v and w from AND elements (ii) Count of counter CT from terminal DOUT (2) From $PIA_2$:

(i) Elevator start signal ES (3) From $PIA_3$:

(i) Floor stop signal CS (ii) Basic floor signal $C_{BS}$

In step 300, the actual running direction of the elevator car is judged in order to determine the counting direction of the reversible counter CT in the car position detecting circuit 11 or in order to determine the direction of error correction in the starting stage of the elevator car as will be described later. In step 400 following the step 300, the presence or absence of a power failure flag (which is prepared according to a power failure interrupt program described later) is detected. When the presence of the power failure flag due to previous power failure is detected in step 400, necessary processing for the restoration of power supply is carried out in step 500. When, on the other hand, the presence of the power failure flag is not detected in step 400, a jump to step 600 occurs while bypassing the step 500. In this processing for the restoration of power supply in step 500, the count of the reversible counter CT in the car position detecting circuit 11 is restored to its normal value.

In step 600, the presence or absence of a flag demanding initialization of the reversible counter CT is detected. This counter initialize demand flag appears when the result of car position rationality check described later proves that the car position is irrational and the reversible counter CT must be initialized. When the presence of the counter initialize demand flag is detected in step 600, the reversible counter CT is initialized in step 800. When, on the other hand, the presence of the counter initialize demand flag is not detected in step 600, routine processing for arithmetically calculating the car position is carried out in step 700.

Upon completion of all of the above steps, a jump to the step 200 occurs again to repeat a sequence similar to that above described.

Before describing the actual processing sequence in each of the above steps of the main program, a mapping of various data stored in the random access memories $RAM_1$ and $RAM_2$ is illustrated in FIG. 11 so that the operation of the elevator control apparatus embodying the present invention can be more clearly understood.

It will be seen from FIG. 11 that the data stored in the random access memories $RAM_1$ and $RAM_2$ is classified depending on whether they may or may not be lost when power failure occurs.

FIG. 12 is a flow chart of a sub-program run for detecting the running direction of the elevator car.

The running direction of the elevator car is generally instructed by a direction command signal applied from the elevator control circuit (not shown). Therefore, the counting direction of the reversible counter CT may also be instructed by this direction command signal. However, when the direction of phase rotation of the output from the AC power source supplying the elevator car drive motor is opposite to the desired direction due to a mistake, it results in such a trouble that the direction of rotation of the motor will be reverse to the car running direction instructed by the direction command signal. From this point of view, it is preferable, for the purpose of accuracy of control and safety of operation, to directly detect the direction of rotation of the car drive motor.

In order to obviate this trouble, the order of application of the input data u, v and w obtained on the basis of the output from the AC tachometer generator ACPG is detected, that is, the direction of phase rotation is detected so as to detect the running direction of the elevator car in step 310 in FIG. 12. For example, the elevator car runs (1) upward when the input data is applied in the order of u→v→w, and (2) downward when the input data is applied in the order of u→w→v.

The order of application of this input data can be easily found since the cycle time of one cycle in FIG. 10 is sufficiently shorter than the pulse width of the data.

After the detection of the running direction of the elevator car, the counting direction of the reversible counter CT in the car position detecting circuit 11 is so set as to conform to the running direction of the elevator car in steps 320 to 340. Upon completion of all of the above steps, the sub-program returns to the main program shown in FIG. 10.

FIG. 13 is a flow chart of a sub-program run for the restoration of power supply. This sub-program is run to restore the count of the reversible counter CT to its normal value in the course of power supply restoration on the basis of the information including the position data and running direction data of the elevator car having been stored in the battery backed-up random access memory $RAM_2$ as a result of previous occurrence of power failure.

In step 510, correction data which will be enough to cover the distance to be run by the elevator car having been subjected to an abrupt stop is added to or subtracted from the corresponding data in the car position table stored in the random access memory $RAM_2$, and the resultant data is preset in the reversible counter CT. (Of course, whether the correction data is added or subtracted depends on the running direction of the elevator car before the occurrence of power failure.)

Although the distance to be run by the elevator car after having been subjected to an abrupt stop due to the occurrence of power failure is not always constant and is variable depending on the factors including the loaded condition and braked condition, an averaged running distance is taken herein for the purpose of correction. When this correction data differs greatly from the actual value, it does not pass the rationality check described later, and the reversible counter CT is set at its initial state.

In next step 520, the counting direction of the reversible counter CT is instructed to conform to the running direction of the elevator car. The counting direction is instructed by a signal UP/DN applied from the C-port of the interface element $PIA_1$ to the terminal UP/DN of the reversible counter CT. For example, this signal UP/DN has a "1" level and a "0" level when the elevator car runs upward and downward respectively.

In steps 530 and 540 following the step 520, a command signal NRUN instructing running of the elevator car toward the nearest floor and a command signal DIR instructing the running direction of the elevator car are applied to the elevator control circuit (not shown).

Finally, in step 550, the power failure flag is cleared, and the sub-program returns to the main program shown in FIG. 10.

FIGS. 14 and 15 are a flow chart of a sub-program for arithmetically processing the position of the elevator car.

This sub-program includes the following processing sequence:

(1) Correction of the car position in the car starting stage (2) Correction of the car position each time the elevator car passes each individual floor (3) Rationality check between the count of the reversible counter CT and the corrected position data of the elevator car at the corresponding floor (4) Output of the data signals to the exterior Practical flow of the successive steps of this sub-program will now be described with reference to FIGS. 14 and 15.

In step 702, whether the basic floor signal $C_{BS}$ is applied to the car position processing unit 13 is judged. When the result proves that the basic floor signal $C_{BS}$ is applied, the numeral 1 is set in the floor number table in the random access memory $RAM_2$ in FIG. 11, in step 704. Then, whether the elevator start signal ES is applied to the elevator start signal interface 12 is judged in step 706. When the result proves that the elevator start signal ES is applied, the timer providing the correction timing in the car starting stage is actuated in step 708, and the start-stop control signal or count inhibit signal ST is applied to the terminal ST of the reversible counter CT in step 710 to inhibit counting operation of the counter CT. When the elevator start signal ES is not applied, a jump occurs from step 706 to step 712 while bypassing the steps 708 and 710.

In step 712, whether the floor stop signal CS is applied to the car position processing unit 13 is judged. When the result proves that the floor stop signal CS is applied, the running direction of the elevator car is detected in step 714, and the numeral 1 is added to the floor number table in step 716 when the elevator car runs upward, or it is subtracted from the table in step 718 when the elevator car runs downward.

In step 720 following the step 716 or step 718, judgement is made as to whether the absolute value of the difference between the count of the reversible counter CT and the corresponding data in the preset floor correction table lies within the range of a predetermined error, that is, rationality check is carried out. When the result of this rationality check proves that the difference lies within the range of the predetermined error, the correction value at the corresponding floor number in the floor correction table is preset in the reversible counter CT in step 722. The manner of car position correction in this step 722 is illustrated in FIG. 5 in which the correction value S is added to the corresponding data at the 2nd floor. When, on the other hand, the result of this rationality check in step 720 proves that the difference does not lie within the range of the predetermined error, a signal BRUN instructing running of the elevator car toward the basic floor is applied from the car position processing unit 13 to the elevator control circuit (not shown) in step 724. At the same time, a flag demanding initialization of the reversible counter CT is displayed in this step 724. When the application of the floor stop signal CS is not detected in step 712, a jump to step 726 occurs.

In step 726, judgement is made as to whether a timer flag has already been displayed as a result of actuation of the timer in the previous step 708, that is, whether the time is exactly the correction timing for the correction of the which occurred in the starting stage of the elevator car. When the result proves that the timer flag is displayed or present, the count inhibit signal ST which appeared in the previous step 710 is released in step 728. Then, the correction data in the car start-stage error correction table is added to or subtracted from the corresponding car position data in the car position table depending on the running direction of the elevator car, and the resultant data is preset in the reversible counter CT in step 732 or 734, as described already with reference to FIG. 5. Then, the timer flag is cleared in step 736. When, on the other hand, the result proves that no timer flag is present, a jump to step 740 occurs while bypassing the steps 728 to 736.

Finally, the necessary information in the car position table POS and that in the car direction table DIR are applied in steps 740 and 742 to the external elevator control circuit (not shown) from the interface element $PIA_3$ in FIG. 9, and this sub-program returns to the main program shown in FIG. 10.

In step 740, the signal indicative of the count itself of the reversible counter CT is applied as an external output. If necessary, however, a signal indicative of the floor number may be applied as an external output.

FIG. 16 is a flow chart of a sub-program for initializing the reversible counter CT during the restoration of power supply after the power failure, when the result of the rationality check of the count of the reversible counter CT described with reference to FIGS. 14 and 15 proves that the count of the reversible counter CT is irrational.

The elevator car is instructed to run toward the basic floor at a low speed under control of the elevator control circuit (not shown), and when the elevator car arrives and stops at the basic floor, the basic floor signal $C_{BS}$ appears. In step 810, application of this basic floor signal $C_{BS}$ to the car position processing unit 13 is detected, and in step 820, the basic floor data $CN_1$ in the floor correction table is preset in the reversible counter CT. Then, in step 830, the counter initialize demand flag is cleared, and the sub-program returns to the main program shown in FIG. 10.

FIG. 17 is a flow chart of a power failure interrupt program.

When power failure is detected, a power failure flag is stored in the random access memory $RAM_2$ in step 10, and the existing count of the reversible counter CT is also stored in the random accsss memory $RAM_2$ in step 15. Then, the running direction of the elevator car is also stored in the random access memory $RAM_2$ in step 20, and the processing sequence ceases. The memory $RAM_2$ storing this data is backed up by the battery, as described hereinbefore.

FIG. 18 is a flow chart of a timer interrupt program. This timer interrupt program is run at time intervals of a predetermined period of time for the purpose of timer processing. In step 30, the counting operation of the counter CT is started upon appearance of a timer start flag and continues until a predetermined value is counted, and this is followed by appearance of a timer count completion flag.

The programs shown in FIGS. 10, 17 and 18 are run according to the following priority order:

(1) Power failure interrupt program shown in FIG. 17

(2) Timer interrupt program shown in FIG. 18

(3) Main program shown in FIG. 10

The foregoing description has clarified both the hardware and the software employed in the elevator control apparatus embodying the present invention.

The features and advantages of the aforementioned embodiment of the present invention will now be summarized.

It is a first feature that an AC tachometer generator is employed for generating a train of pulses indicative of the position of the elevator car. The reliability of this AC tachometer generator is generally higher than that of conventional pulse generators. Therefore, it can generate output pulses with a higher reliability than the latter. The AC tachometer generator has also such an economical advantage that it requires less maintenance and it is less expensive than the conventional pulse generators.

It is a second feature that a three-phase AC generator is used as this AC tachometer generator. The three-phase AC generator can generate output pulses three times as many as those generated from a single-phase AC generator, and therefore, the accuracy of detection of the elevator car position can be improved.

It is a third feature that the counting direction of the car position detecting counter is determined and the correction data is added to or subtracted from the count of the counter depending on the direction of phase rotation of the three-phase AC output from the tachometer generator. Therefore, the correction data can be added or subtracted according to the actual running direction of the elevator car, and the reliability becomes higher than possible.

It is a fourth feature that a floor correction table is previously prepared for each of the floors so that the count of the car position detecting counter can be corrected to be equal to the normal value each time the elevator car passes one of the floors. Therefore, the elevator car can be controlled on the basis of a more accurate position when the elevator car runs over more than two floor intervals.

It is a fifth feature that a microcomputer is employed to control the counting operation of the car position detecting counter and to carry out necessary processing for the correction, and all the necessary data is stored in a battery backed-up memory to be read out in the event of occurrence of power failure. Therefore, the complicated processing sequence can be easily carried out, and the procedure required for the restoration of power supply after the occurrence of power failure is also facilitated.

In the aforementioned embodiment, the error due to the undetectable speed $V_e$ is corrected at predetermined timing or within a predetermined period of time after detection of the elevator start signal ES. In a modification of the embodiment, the car position may be corrected at the time of detection of the floor stop signal CS. In another modification, the car position may be corrected in response to the door open zone signal appearing before or after the floor stop signal CS depending on the running direction of the elevator car. These modifications can exhibit the same effects as those of the aforementioned embodiment.

In the aforementioned embodiment, the random access memory $RAM_2$ shown in FIG. 9 is only backed up by a battery. In a modification of the embodiment, all the elements of the car position detecting circuit 11 shown in FIG. 6 may also be backed up by a battery. This arrangement is convenient since the car position can be satisfactorily counted in the event of power failure, and there is no need for the rationality check of the car position during the restoration of power supply. It is to be pointed out, however, that this battery back-up arrangement for all the elements of the car position detecting circuit 11 leads to an increased cost because a power supply battery of large capacity is required for the back-up of the operational amplifiers, the gates and/or the counter.

As another modification, the command signal instructing the running direction of the elevator car may be utilized for determining the counting direction of the reversible counter CT in the car position detecting circuit 11 shown in FIG. 6.

In the aforementioned embodiment, the car position is corrected each time the elevator passes the individual floors. In a modification as shown in FIG. 19, the car position may be corrected at, for example, the 3rd floor which is next adjacent to a target floor, for example, the 4th floor at which the elevator car is to be stopped. This modification eliminates some of the steps required for the calculation of the car position because correction of the car position at, for example, the 2nd floor is unnecessary.

What we claim is:

1. An elevator control apparatus for an elevator car which is mounted for movement between a plurality of floors of a building, comprising means for driving the elevator car, means for generating a train of pulses corresponding to the running distance of the elevator car driven by said driving means, car position detecting means including means for counting the number of said pulses to detect the instantaneous position of the elevator car, means for controlling the elevator car depending on the detected position of the elevator car as indicated by said car position detecting means, means for storing predetermined pulse number correction data representing a correction factor relating to the operating characteristic of the elevator car, and means for correcting the count of said car position detecting means with said correction data each time the elevator car is actuated from its standstill condition.

2. An elevator control apparatus as claimed in claim 1, wherein said correcting means corrects the count of said car position detecting means at least before the acceleration of the elevator car is completed after it has started to run from its standstill condition.

3. An elevator control apparatus as claimed in claim 2, wherein said correcting means corrects said count in response to the appearance of an elevator car start signal.

4. An elevator control apparatus as claimed in claim 2, wherein said correcting means includes timing means actuated in response to the appearance of an elevator car start signal for generating a timing output after a predetermined period of time, and means for correcting said count in response to receipt of said timing output from said timing means.

5. An elevator control apparatus as claimed in claim 2, wherein said correcting means corrects said count in response to the appearance of a door open zone signal instructing opening of the door of the elevator car.

6. An elevator control apparatus as claimed in claim 1, wherein said correcting means includes means for adding said correction data to or subtracting said correction data from said count depending on the running direction of the elevator car.

7. An elevator control apparatus as claimed in claim 1, wherein said pulse generating means includes an AC tachometer generator rotating with the running movement of the elevator car and means for converting the AC output from said generator into said pulses.

8. An elevator control apparatus as claimed in claim 7, wherein said AC tachometer generator is provided in the form of a three-phase AC generator, and means is provided for detecting the running direction of the elevator car by detecting the direction of phase rotation of the three-phase AC output from said generator.

9. An elevator control apparatus as claimed in claim 8, wherein said car position detecting means includes means for changing over between pulse addition and subtraction depending on the output from said running direction detecting means.

10. An elevator control apparatus as claimed in claim 8, wherein said correcting means includes means for adding said correction data to or subtracting said correction data from said count depending on the output from said running direction detecting means.

11. An elevator control apparatus as claimed in claim 1, further comprising floor position designating means for storing a plurality of data items corresponding respectively to the positions of said plural floors, and means responsive to the elevator car passing any one of the floors for resetting the count in said car position detecting means so that the count at that time conforms to the corresponding data stored in said floor position designating means.

12. An elevator control apparatus as claimed in claim 1, wherein said pulse generating means is of the type wherein the amplitude of the output thereof varies with the speed of the elevator car, and wherein said correction data represents a correction factor in the car position relating to the movement of the car at such low speed that accurate detection of the output of said pulse generating means is not possible.

13. An elevator control apparatus comprising an elevator car making a service run over a plurality of floors of a building, means for driving the elevator car, a three-phase AC generator rotating with the running movement of the elevator car driven by said driving means, means for converting the output from said three-phase AC generator into a train of pulses, means for counting the number of said pulses thereby detecting the position of the elevator car for the purpose of controlling the elevator car depending on the detected position of the elevator car and also on the running direction of the elevator car, and means for detecting the running direction of the elevator car by detecting the direction of phase rotation of the three-phase AC output from said three-phase AC generator in response to the application of the output thereto.

14. An elevator control apparatus for an elevator car which is mounted for movement between a plurality of floors of a building, comprising means for driving the elevator car, means for generating a train of pulses corresponding to the running distance of the elevator car driven by said driving means, car position detecting means including means for counting the number of said pulses to detect the instantaneous position of the elevator car, means for controlling the elevator car depending on the detected position of the elevator car as indicated by said car position detecting means, means for storing pulse number floor position data corresponding to the respective positions of said plural floors, means for storing predetermined pulse number correction data representing a correction factor relating to slow speed operation of said elevator car, first means for correcting the count of said car position detecting means in accordance with said stored pulse number position data whenever the elevator car is present at a floor, and second means for correcting the count of said car position detecting means with said stored pulse number correction data each time the elevator car is actuated from its standstill condition.

15. An elevator control apparatus as claimed in claim 14, wherein said second correcting means includes means for adding said correction data to or subtracting said correction data from said count depending on the running direction of the elevator car.

16. An elevator control apparatus as claimed in claims 14 or 15, wherein said pulse generating means includes an AC tachometer generator rotating with the running movement of the elevator car and means for converting the AC output from said generator into said pulses.

17. An elevator control apparatus as claimed in claim 16, wherein said AC tachometer generator is provided in the form of a three-phase AC generator, and means is provided for detecting the running direction of the elevator car by detecting the direction of phase rotation of the three-phase AC output from said generator.

* * * * *